US007396006B2

(12) United States Patent
Kapturowski et al.

(10) Patent No.: US 7,396,006 B2
(45) Date of Patent: Jul. 8, 2008

(54) APPARATUS FOR ASSEMBLY OF DOCUMENT SETS INTO A SINGLE COLLATED PACKET

(75) Inventors: Edward J. Kapturowski, Apex, NC (US); Richard D. Johnson, Fuquay-Varina, NC (US); Joseph I. Zuech, Hillsborough, NC (US)

(73) Assignee: Bowe Bell + Howell Company, Durham, NC (US)

( * ) Notice: Subject to any disclaimer, the term of this patent is extended or adjusted under 35 U.S.C. 154(b) by 296 days.

(21) Appl. No.: 11/240,604

(22) Filed: Oct. 3, 2005

(65) Prior Publication Data

US 2007/0075475 A1 Apr. 5, 2007

(51) Int. Cl.
*B65H 39/00* (2006.01)

(52) U.S. Cl. ..... 270/52.14; 270/52.01; 270/52.16; 270/52.19; 53/447; 53/540

(58) Field of Classification Search ..... 270/52.01, 270/52.14, 52.16, 52.19; 53/447, 540
See application file for complete search history.

(56) References Cited

U.S. PATENT DOCUMENTS

| | | | | |
|---|---|---|---|---|
| 3,207,017 | A | 9/1965 | McCain | |
| 3,275,118 | A | 9/1966 | McCain et al. | |
| 4,071,997 | A * | 2/1978 | Gunther et al. | 53/429 |
| 4,299,073 | A * | 11/1981 | Golicz et al. | 53/493 |
| 4,541,764 | A | 9/1985 | Govan et al. | |
| 4,694,631 | A * | 9/1987 | Gunther, Jr. | 53/55 |
| 4,694,632 | A * | 9/1987 | Gunther, Jr. | 53/55 |
| 4,753,429 | A | 6/1988 | Irvine et al. | |
| 4,787,192 | A * | 11/1988 | Gunther, Jr. | 53/56 |
| 5,255,498 | A * | 10/1993 | Hotchkiss et al. | 53/569 |
| 5,581,972 | A * | 12/1996 | Antonelli | 53/75 |
| 6,341,773 | B1 * | 1/2002 | Aprato et al. | 271/9.13 |
| 6,915,184 | B2 | 7/2005 | Yates et al. | |
| 2003/0233167 | A1 | 12/2003 | Yates et al. | |
| 2004/0035527 | A1 | 2/2004 | Cook | |
| 2004/0186616 | A1 | 9/2004 | Overman et al. | |
| 2007/0145659 | A1 | 6/2007 | Kapturowski et al. | |
| 2007/0164496 | A1 | 7/2007 | Kapturowski et al. | |

FOREIGN PATENT DOCUMENTS

| | | |
|---|---|---|
| DE | 203 20 537 | 10/2004 |
| EP | 0 113 011 | 7/1984 |
| EP | 1 770 042 A2 | 4/2007 |
| FR | 2 587 015 | 3/1987 |

OTHER PUBLICATIONS

European Search Report for Corresponding Application EP 06 01 8903 dated Mar. 13, 2007.
Feb. 22, 2008 extended European Search Report, Appln. No. 07017896.7-2314.

* cited by examiner

*Primary Examiner*—Gene O. Crawford
*Assistant Examiner*—Leslie A Nicholson, III
(74) *Attorney, Agent, or Firm*—McDermott Will & Emery LLP

(57) ABSTRACT

A collating apparatus and method to merge different types of document sets into a single collated packet prior to a mail processing insertion operation. The collating device utilizes a synchronous conveyor pathway for conveying different types of document sets serially down the pathway and merging them into a single collated packet. The document sets are delivered downstream with a combination of pivotable and fixed position pusher members and are combined into a single collated packet in any desired order.

25 Claims, 6 Drawing Sheets

APPARATUS FOR ASSEMBLY OF DOCUMENT SETS INTO A SINGLE COLLATED PACKET

TECHNICAL FIELD

The present subject matter relates to a collating apparatus and method for merging documents. More particularly, the present subject matter relates to a collating apparatus and method for merging document sets, one or more of which may be previously collated, into a single collated packet prior to a mail processing insertion operation.

BACKGROUND

Various mailing systems and methods have been employed in the past for receiving materials from a number of sources and collating the materials, or combining them into a single packet of material. The single packet is then inserted into an envelope at an envelope inserting station located further downstream.

In known mailing systems, the prime document is typically generated or fed and additional materials are added to the prime document as it traverses the mail processing system. Typically, the packet is comprised of a single stack of documents, wherein the order of the documents in the stack is predetermined by the process flow of the mail processing system.

Known track systems feed documents from a series of feed stations in a synchronized manner so that a document from each feed station is placed on top of a document from a preceding, up-stream feed station. A number of documents are collated together to form a packet and at the end of the track the packet is inserted into an envelope. Usually the packet of documents comprises one prime document, such as an address bearing document, and several attachments, such as leaflets or advertisements. The prime document includes the mailing address to which the package (e.g. envelope with packet inserted therein) is to be delivered and the collating must be done so that when the documents are placed in a window envelope, the address will be visible through the window. This process can be done by first feeding the prime document onto the track conveyor, face downwards, and adding the subsequent documents on top to form a packet which is then inserted into the envelope with the prime document facing downwards.

U.S. Pat. No. 4,753,429 discloses a synchronous system that uses two fixed pins of different heights and provides a method of collation for two subsets of documents into a single packet. With this system, the document which is to be placed on top of the packet must be transported by the first (shorter) set of pins in the synchronous transport.

In U.S. Pat. No. 6,915,184, a document collator includes a conveyor system, a prime document feeder station and a plurality of enclosure document feeder stations arranged at spaced locations along the conveyor system. The collator is a non-synchronous system that allows the order of a collation to be varied within a mail processing system by sequencing the order in which the documents are fed.

Accordingly, there remains room for improvement in the art for a synchronous collating apparatus and method for merging a plurality of document sets into a single set, in any desired order.

SUMMARY

The present claimed subject matter improves on the concepts of known mailing systems with the use of pivotable pusher members such as pins. Serial document sets can be assembled in any order, and the height of the pusher pin is not dictated by the collation process. The present claimed subject matter uses pivotable (or drop away) pusher pins in combination with fixed position pusher members, as well as an actuating deck plate which permits the document sets to be assembled in any order at a collation station. If, in fact, the address bearing document is allowed in the last position, there are additional benefits accrued when in the timing of placing the address bearing document into the synchronous raceway.

Moreover, present subject matter is combined with more traditional mail processing architecture and capable of achieving results similar to existing systems. The document sets are fed in customary sequence into a moving conveyor chain, where each pocket in the conveyor chain, contains a plurality of "sub-pockets" which are defined by one or more drop away pusher pins. At the collator, these document sets are combined into a single collated packet, in any desired order.

Accordingly, the present claimed subject matter is an improved collating apparatus for merging a plurality of document sets prior to their arrival at a high-speed inserting device.

It is desirable to provide collating apparatus comprising a substantially elongated raceway conveyor adapted to convey a plurality of document sets consecutively along a substantially horizontal conveying pathway from an initial upstream position to a downstream position. A plurality of pivotable pusher members are movably mounted to the raceway conveyor adapted to advance a first document set. A plurality of fixed positioned pusher members are movably mounted to the raceway conveyor and are adapted to advance a second document set. An actuating deck plate is positioned on a upper surface of the raceway conveyor and parallel to the substantially horizontal conveying pathway, and a selective actuating mechanism is adapted to raise one end of the actuating deck plate from an initial position substantially flush with the upper surface of the raceway conveyor to a predetermined position above the upper surface of the raceway conveyor. A collating station comprising a first elevated platform mounted on the upper surface of the raceway conveyor downstream from the actuating deck plate.

In accord with the present concepts disclosed herein, there is provided a method of combining a plurality of document sets into a merged packet. The method comprises the following sequential steps conveying a first document set along a first conveying pathway from an initial upstream position toward a downstream collation station with at least one pivotable pusher member movably mounted to a raceway conveyor. A second document set is conveyed behind the first document set with at least one fixed positioned pusher member movably mounted to the raceway conveyor. Conveyance of the first document set is stopped at the collation station following a backward pivoting of the pivotable pusher member from an upright position to a downward position below the conveying pathway. A selective actuating mechanism is then to elevate one end of an actuating deck plate to an inclined position. The second document set is conveyed to a second conveying pathway above the first conveying pathway such that the second document set passes across the actuating deck plate and onto a first elevated platform mounted on the upper surface of the raceway conveyotr. The first and second document sets are simultaneously advanced at an instance when the fixed positioned pusher member arrives at the collation station and, thereby, conveying the second document set. The first and second document sets are merged on the first conveying pathway, such that the second document set overlays the first document set and forms the merged packet.

It is also desirable to provide collating apparatus comprising a substantially elongated raceway conveyor adapted to convey a plurality of document sets consecutively along a substantially horizontal conveying pathway from an initial upstream position to a downstream position. A plurality of pivotable pusher members are movably mounted to the raceway conveyor adapted to advance a plurality of document sets. A plurality of fixed positioned pusher members are movably mounted to the raceway conveyor and are adapted to advance another document set. An actuating deck plate is positioned on a upper surface of the raceway conveyor and parallel to the substantially horizontal conveying pathway, and a selective actuating mechanism is adapted to raise one end of the actuating deck plate from an initial position substantially flush with the upper surface of the raceway conveyor to plurality of predetermined positions above the upper surface of the raceway conveyor. A collating station is present and comprises at least two elevated platforms mounted one on top of the other on the upper surface of the raceway conveyor downstream from the actuating deck plate. The plurality of fixed positioned pusher members are spaced from each other at regular intervals intermediate to at least two consecutive pivotable pusher members.

Additional advantages and aspects of the present subject matter will become readily apparent to those skilled in the art from the following detailed description, wherein embodiments of the present subject matter are shown and described, simply by way of illustration of the best mode contemplated for practicing the present subject matter. As will be described, the present subject matter is capable of other and different embodiments, and its several details are susceptible of modification in various obvious respects, all without departing from the spirit of the present subject matter. Accordingly, the drawings and description are to be regarded as illustrative in nature, and not limitative.

BRIEF DESCRIPTION OF THE DRAWINGS

The following detailed description of the embodiments of the present subject matter can best be understood when read in conjunction with the following drawings, in which the various features are not necessarily drawn to scale but rather are drawn as to best illustrate the pertinent features, and in which like reference numerals are employed throughout to designate similar features.

DETAILED DESCRIPTION

Figure 1:
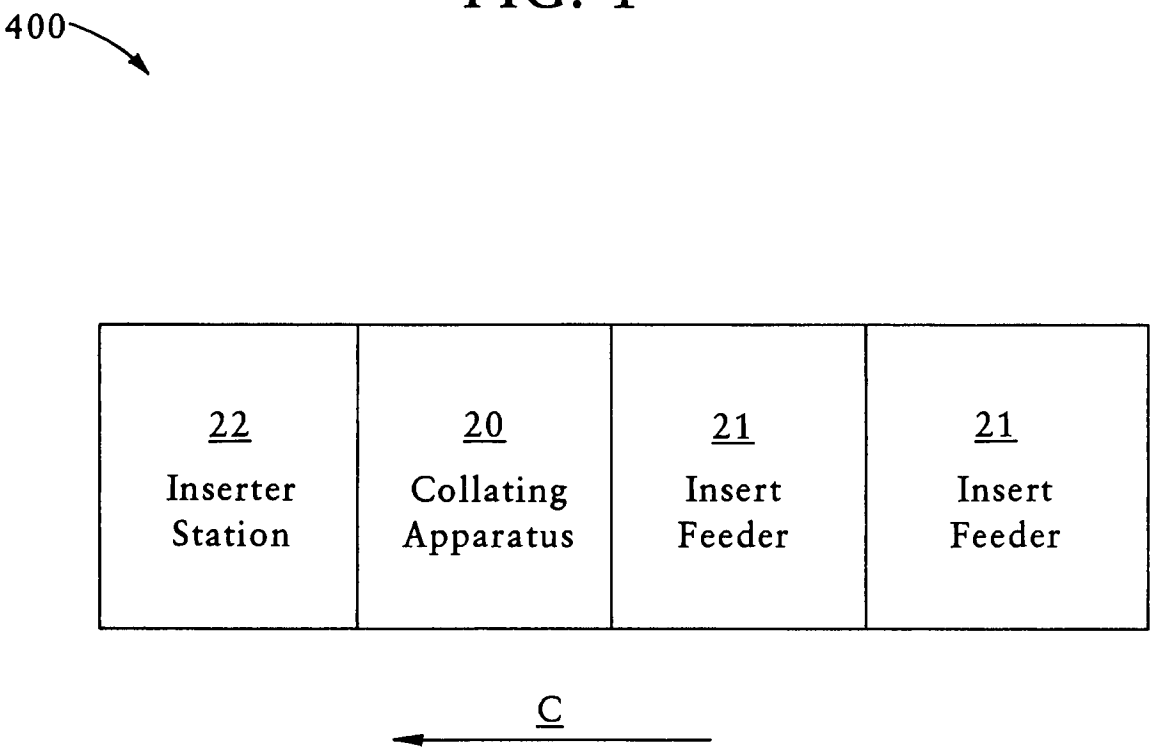
FIG. 1 illustrates an example of a collating apparatus situated within a mail processing system.

The present collating apparatus is configured to function with a conventional in-line mail processing. As exemplified in FIG. 1, collating apparatus 20 is situated between a downstream inserter station 22 and upstream insert feeders 21 within an in-line mail processing system 100. Directional arrow C indicates the direction of documents traveling along the in-line mail processing system 400. Additional mail processing components positioned downstream from inserter station 22 may include for example a sealer, envelope feeder, diverter, conveyor, and flat conveyor, all of which are well known in the industry and are not shown in the FIG. 1 for illustrative simplicity. Additional components positioned upstream from inserter 22 may include conventional input stations (not shown) and the like.

Figure 2:
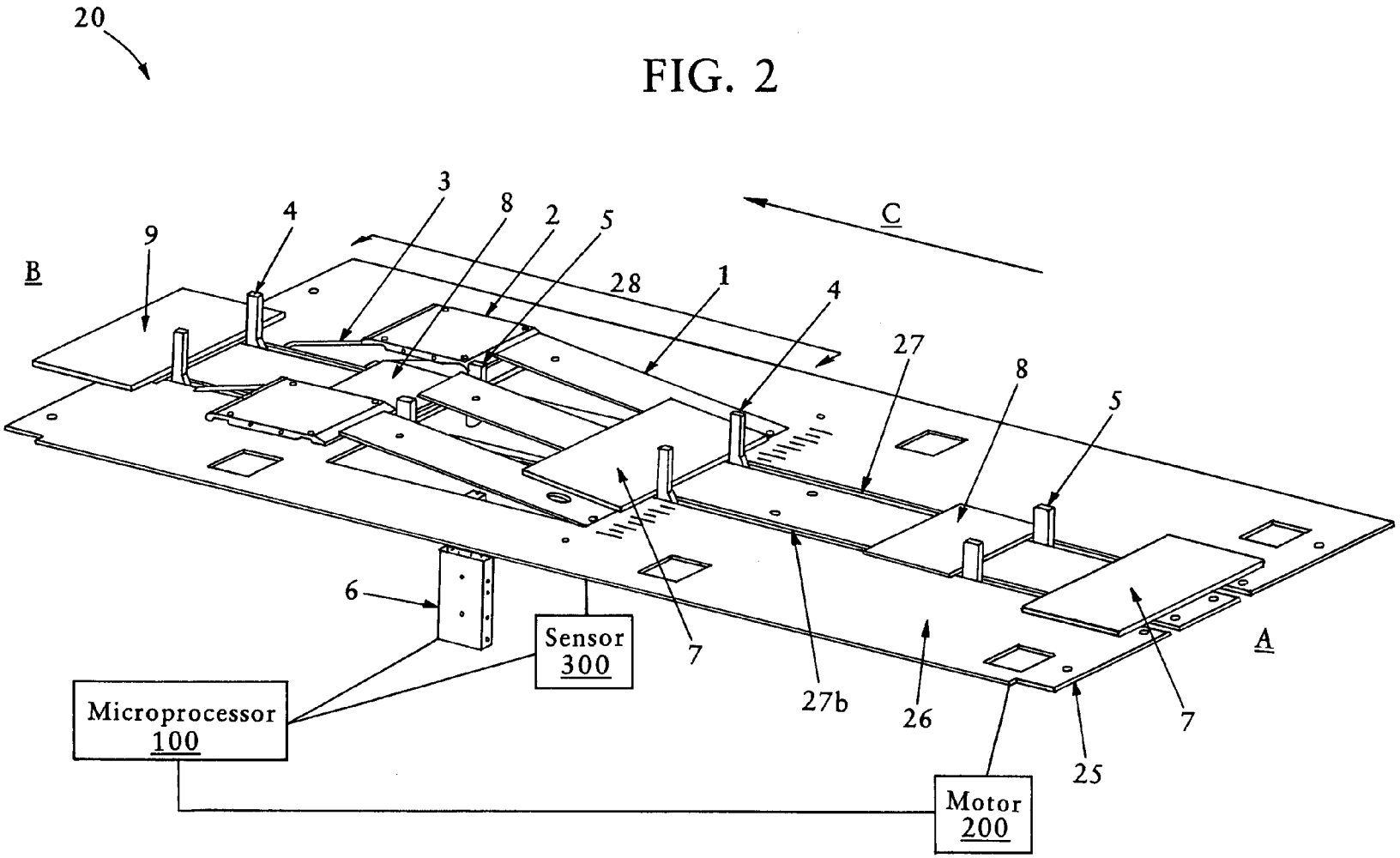
FIG. 2 is an elevated side plan view of the collating apparatus.

The collating apparatus 20 is adapted to advance sequentially delivered document sets, one or more of which may be previously collated, and assemble the document sets into a single collated packet for mailing. Each document set includes one or more sheets or pages of paper material or other articles intended for mail delivery. Non-limiting examples of mailable materials, other than sheets of paper, include compact discs (CD) and digital video discs (DVD). This is accomplished by incorporating two or more pathways into a single collation device as shown in FIG. 2. Drop-away pusher pins 5 that advance a lead document set 8, disappear below the raceway surface and the lead document set 8 is left deposited at a collating station, being trail edge registered. A second set of fixed-position pusher pins 4 advances the trailing document set into trail edge registration with the previously deposited lead document set 8. The second set of fixed position pusher pins 4 removes and assembles both sets of documents 7 and 8 into a single trail edge registered mail packet 9. The single trail edge registered mail packet 9 is then advanced by the second set of fixed position pusher pins for further processing, e.g. at an envelope inserting or stuffing station. The inserting or stuffing station is adapted for receiving, supporting, and sequentially feeding envelopes, one at a time, into the document feed path at an area adjacent the downstream portion of the conveyor. The stuffing station is constructed for positioning envelopes, one at a time, for receiving therein a collated set of documents. After each envelope is sequentially stuffed by having a collated set of documents inserted into the fixed envelope, the stuffed envelope is conveyed to the downstream end of the raceway conveyor for additional handling.

Figure 3:
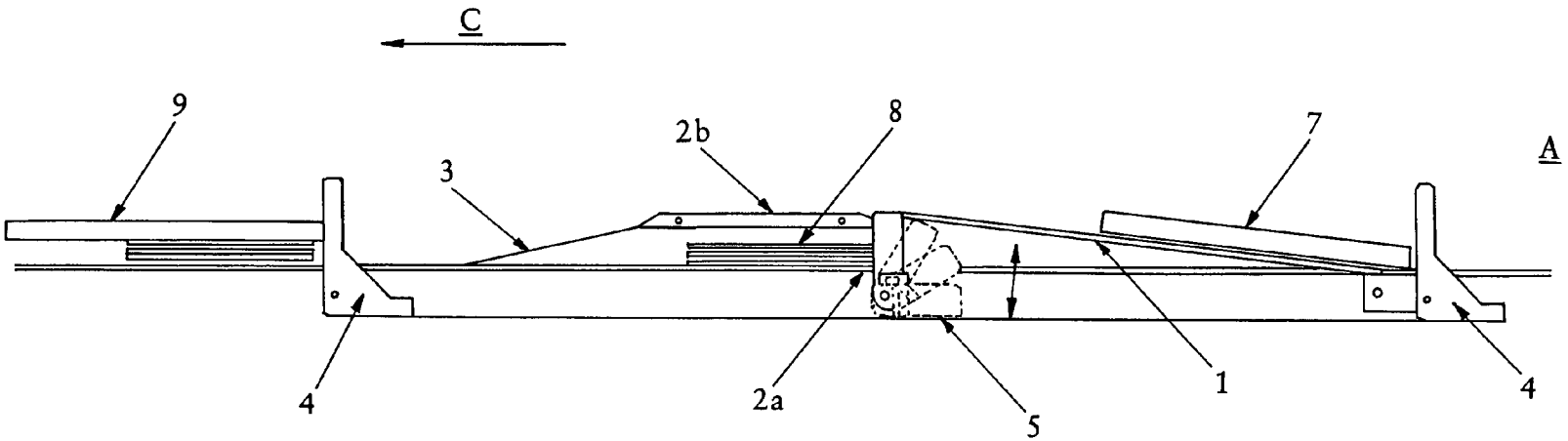
FIG. 3 is a side plan view of the collating apparatus.
Figure 4:
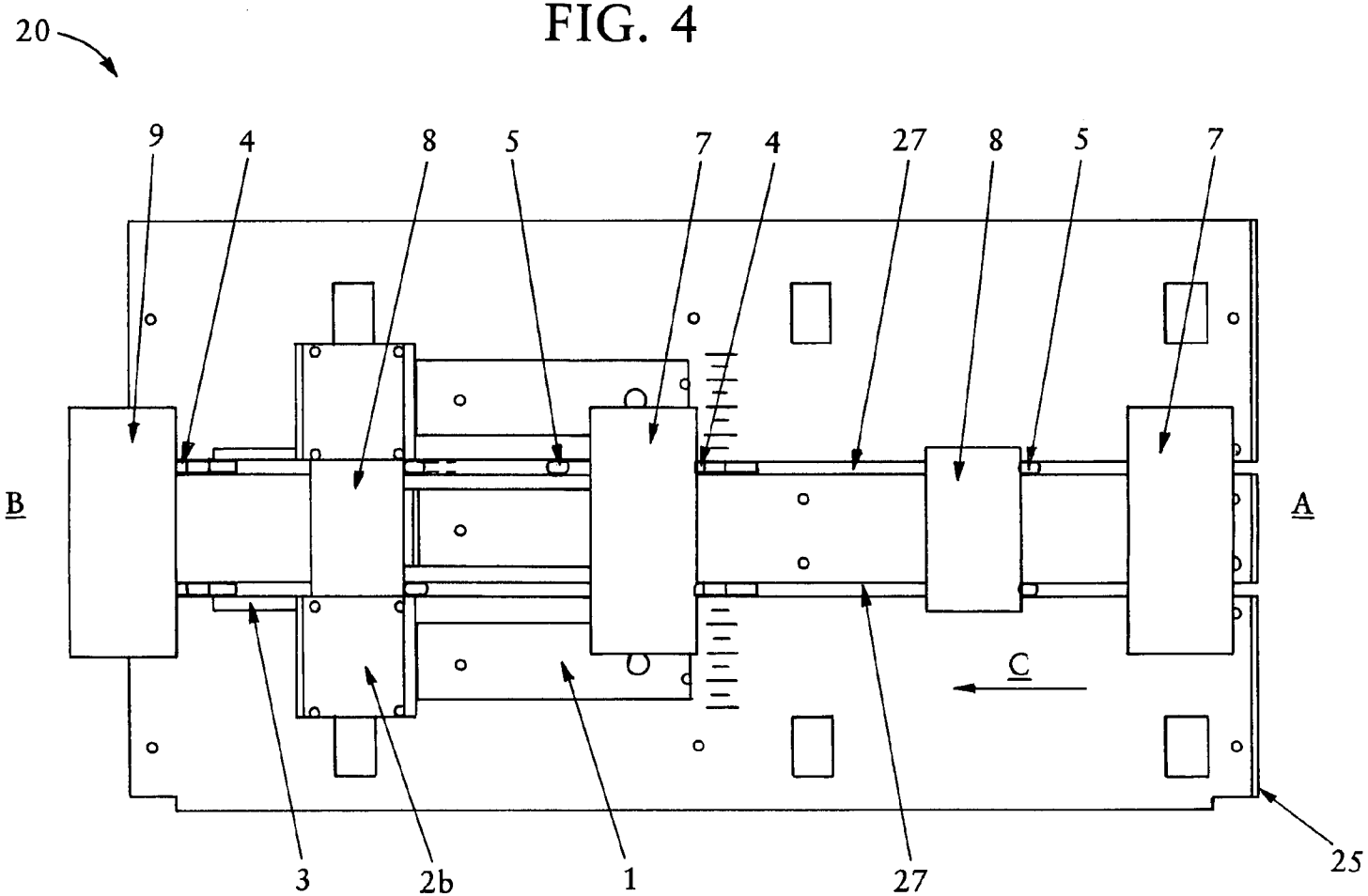
FIG. 4 of the drawings is a top plan view of the collating apparatus.

A first example of the architecture for the collating apparatus 20 is depicted in FIGS. 2 to 4. Collating apparatus 20 includes a substantially elongated synchronous raceway conveyor 25 having an upper surface 26. Raceway conveyor 25 is configured to advance a plurality of document sets consecutively along the substantially horizontal conveying pathway 27 from an initial upstream position A to a downstream position B in the direction indicated by directional arrow C. The plurality of document sets is merged into a combined mail packet before being inserted into an envelope at a downstream inserter. Each document set includes one or more sheets or pages of paper material or other article(s) intended for mail delivery.

The components of the mail packet 9 to be assembled are transported along the conveying pathway 27 of collating apparatus 20 as a series of sequential document sets which can be selectively combined in a predetermined order at a collation station. During normal operation of collating apparatus 20, two different document sets are shown in FIG. 2. A prime document set 7 and a second set 8 are depicted in FIG. 2. In this example, the prime document set is the address bearing document. The second document set 8 can include one or more pages of inserts that were previously assembled in a conventional fashion as a synchronized conveyor (not shown) passes under upstream insert feeders 21 (depicted in FIG. 1).

Figure 5:
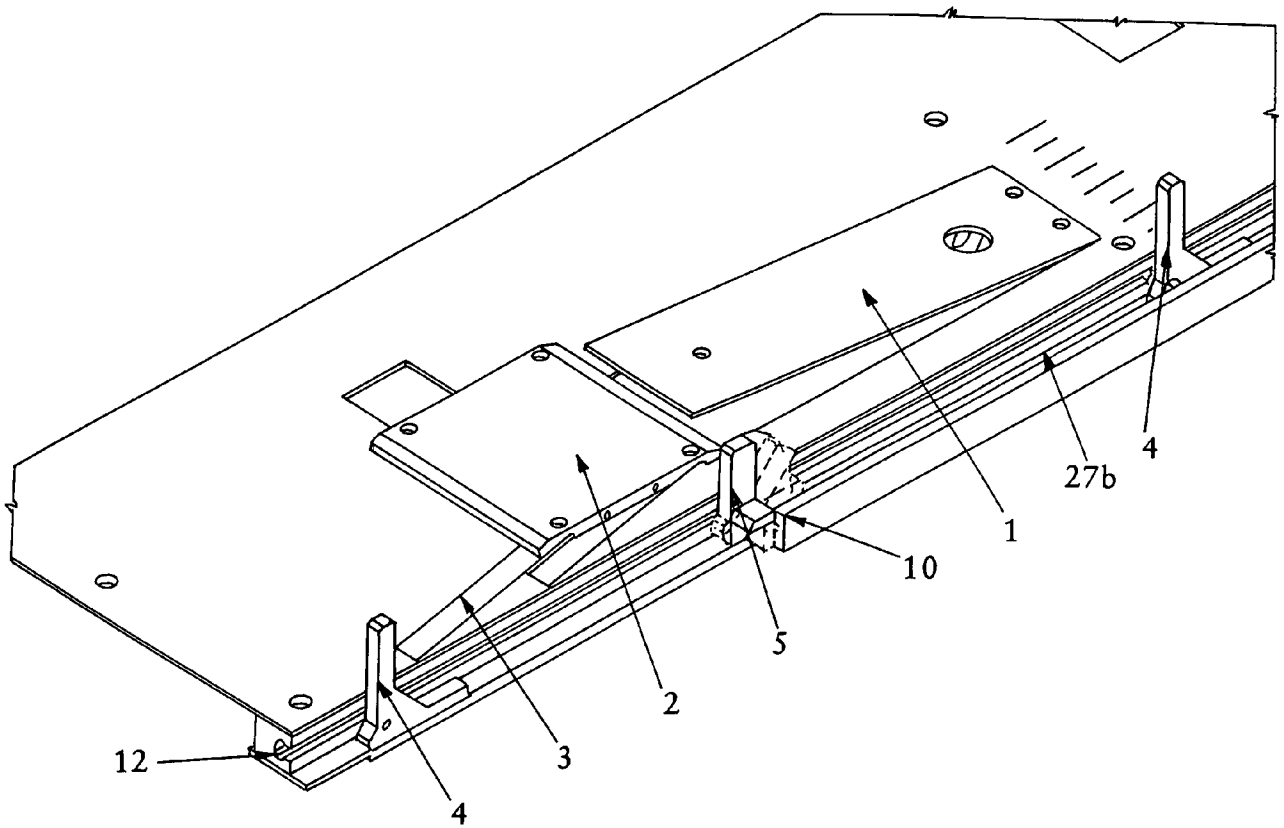
FIG. 5 is a partial side plan view of another example of a collating apparatus.

A plurality of pusher pins positioned within the conveying pathway 27, deliver document sets 7, 8, along synchronous raceway conveyor 25. FIG. 5 depicts the conveying pathway 27 is formed with a pair of parallel, spaced part, longitudinally extending slots 27*b* through which drop away pusher pins 5 and fixed position pusher pins 4 extend. As shown in FIG. 5, pusher pins 4, 5 are coupled to and move along a grooved track 12 positioned below the longitudinally extending slots 27*b* and advanced with a chain (not shown). Fixed position pusher pins 4 are fastened to a chain by way of pins and clips, such as E-clips). The clips retain the pins and pick it to the chain. An anti-rotation pin is used with the fixed position pusher pins 4 as well such that the position of the pin is maintained or fixed. The drop away pusher pins 5 are secured to the chain by way of a mounting pin, such as one or more pick mounting pins. The pusher pins 4, 5 are adapted to intercept, contact, push and advance the document sets downstream along the conveying pathway 27.

Document sets 7, 8 are delivered to the synchronous raceway conveyor 25 by conventional mail processing methods from upstream insert feeders 21. In FIG. 2, each document set 8 is conveyed by the drop away pusher pins 5. Drop away pusher pins 5 are designed to drop away at the precise moment that a document set 8 is transported downstream to collation station 2*a*, as shown in FIG. 3. For document set 8, an actuating deck plate 1 is in the horizontal or down position, so the collation point for document set 8 is at the raceway conveyor 25 level. The advancement of document set 8 is halted at the point when the drop away pusher pins 5 pivot downward from an upright drive position down to a position below the synchronous raceway conveyor 25 and out of contact with document set 8. The mechanism is designed such that once support is removed from the "foot" 5*b* of the drop away pusher pin, the weight of the foot 5*b* causes the drop away pusher pin to pivot backwards (rotate clockwise) by way of gravity. In other words, the weight of the foot 5*b* causes the drop away pusher pin 5 to rotate clockwise to a position below the synchronous raceway conveyor 25. This mechanism can be augmented by a torsion spring for faster rotation drop away pusher pin 5. As a result of the drop away pusher pin 5 rotating below the synchronous raceway conveyor 25, and out of contact with document set 8, document set 8 is deposited at collation station 2*a*.

In FIG. 5, the backward pivoting action of the drop away pusher pins 5 is illustrated. Drop away pusher pins 5 are designed to rotate backwards at the precise moment that document set 8 is delivered downstream to collation station 2*a*. Drop away pusher pins 5 rotate backwards once they clear edge 10 of the raceway conveyor 25, as illustrated in FIG. 5. Drop away pusher pins 5 are spaced from each other along the chain(s) of the conveying pathway 27. Similarly, fixed-position pusher pins 4 are longitudinally spaced from each other along the chain(s) of the conveying pathway 27 and are positioned intermediate the drop away pusher pins 5. Meanwhile, document set 7 is immediately trailing document set 8 and is advanced by the fixed-position pusher pins 4. Fixed position pusher pins 4 are fixed or maintained in an upright position and do not drop away below the synchronous raceway conveyor 25, as with the drop away pusher pins 5. As document set 7 approaches the actuating deck plate 1, the deck plate is raised to an upwardly angled position such that document set 7 is advanced across the top surface of the raised actuating deck plate 1 to a second conveying pathway 28 (FIG. 2) elevated above conveying pathway 27. The region defined by the elevated second conveying pathway begins at approximately the point at which document set 7 begins to cross over the raised actuating deck plate and ends at the point when document sets 7 and 8 are merged together on conveying pathway 27.

When the fixed-position pusher pins 4 reach the collation point 2*a*, they will come into contact with the stationary document set 8. At that point of contact at collation point 2*a*, the fixed-position pusher pins 4 simultaneously advance both document sets 7 and 8. Document set 7 is next transported down the fixed ramp 3 and merged, trailing end registered, with document set 8. When the document sets 7 and 8 arrive at the collation point 2*a*, the document set 7 can be selectively (as determined by operator selection or by the design implementation) positioned either on top of the insert document set 8 or, alternatively, underneath the insert document set 8. The selectivity can be fixed, such that the packet being pushed by the drop away pusher pin is always deposited on the bottom of the assembled packet. Alternatively, the selection can be specified by the operator as part of the normal "job" configuration that is necessary for a typical inserter system. The now assembled mail packet 9 is next transported along the conveying pathway 27 for additional processing at an envelope inserting station positioned downstream.

The actuating deck plate 1 is controlled by a two-state actuator such as a solenoid, a pneumatically operated cylinder or the like. The actuating deck plate, as depicted in FIG. 2, is comprised of three platforms connected by a common mechanical linkage such that all of the deck plates are positioned by a common actuator. In FIG. 2, a solenoid 6 is depicted which is adapted to raise one end of the actuating deck plate 1 to substantially the same height as platform 2*b*. Platform 2*b* is an elevated platform mounted on the upper surface of the raceway conveyor downstream from the actuating deck plate 1. In FIG. 3, document set 7 is advanced with fixed-position pusher pins 4 across the top surface of the elevated actuating plate 1, such that document set 7 will continue to advance on and across the surface of platform 2*b*.

In another example, the collating device 20 comprises a conveying pathway that is formed with a single, spaced part, longitudinally extending slot through which drop away pusher pins 5 and fixed position pusher pins 4 extend. A single column of alternating drop away and fixed position pushers pins extend through the longitudinally extending slot of the conveying pathway. The actuating deck plate is comprised of two deck platforms with the conveying pathway running between the two deck platforms. The actuating deck plate is raised and lowered with a two-state actuator. First and second document sets are advanced in a similar manner as previously discussed. As the fixed-position pusher pin reaches the collation point, it will come into contact with the document set already deposited at the collation point via the drop away pusher pin. At the point of contact at the collation point, the fixed-position pusher pin simultaneously advances both document sets. The second document set is transported down a fixed ramp from the platform and merged with the first document set. The platform is positioned above the conveying pathway and over the collation point and is separated with a gap through its middle section to permit the fixed position pusher pin to pass through platform.

Figure 6:
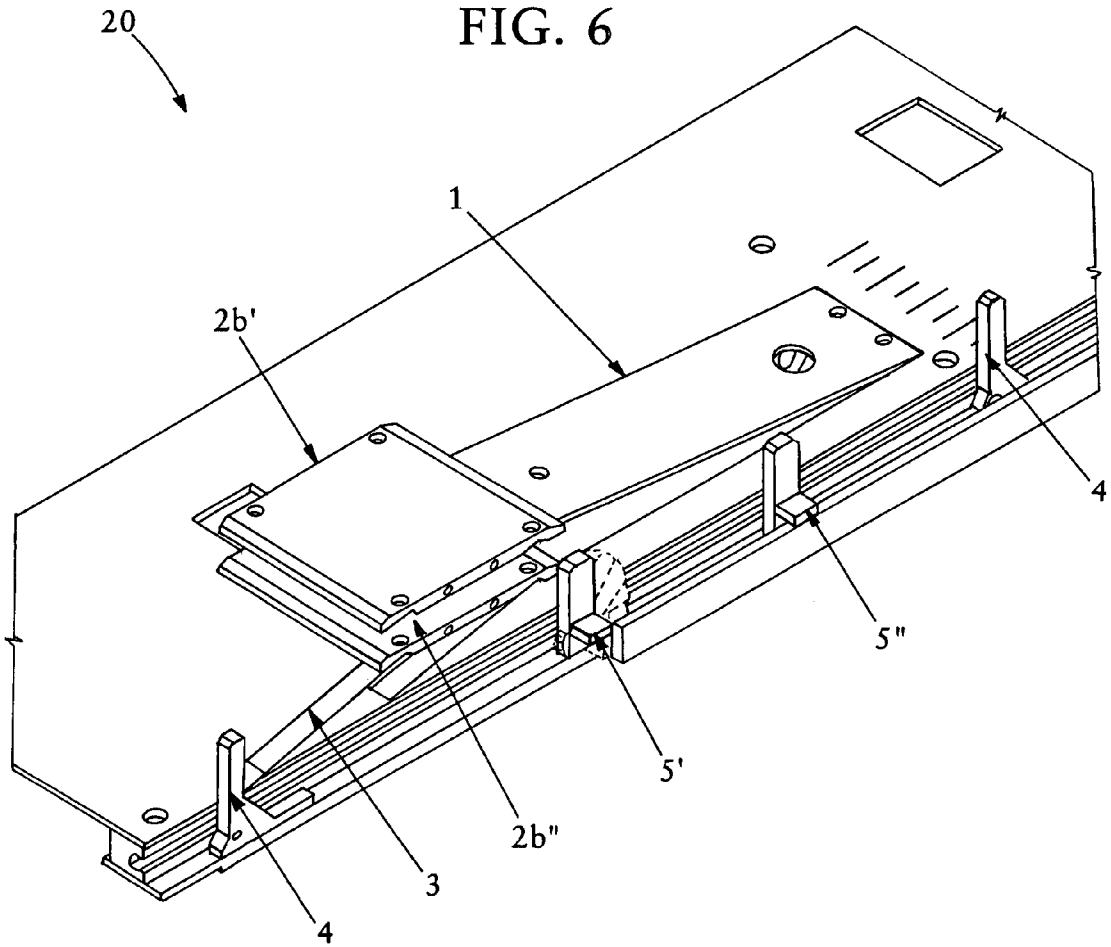
FIG. 6 is a side plan view of another example of a collating apparatus.

In another example, the collating apparatus 20, can accommodate multiple document sets 7. As shown in FIG. 6, a first document set 7 (not shown) is advanced with a drop away pusher pin 5' and a second trailing document set 7 (not shown) is advanced with drop away pusher pins 5". The number of consecutive drop away pusher pins will correspond with the number of levels of platform (2*b*', 2*b*", etc.) above the raceway level. An actuator with finer resolution, such as a stepper motor and drive linkage are necessary to accommodate multiple document sets in this example. As an example, a document set that is being advanced by a drop away pusher pin is capable of being deposited on any platform (2*b*', 2*b*", etc.). Each platform level can accept one document set delivered by a drop away pusher pin. The actuator is designed to insure that the actuating deck plate is raised to a proper position at each level of the platform. The association of a document set to a specific platform level can be fixed or selective by a configuration "job".

The operation of the present collating apparatus 20 can be controlled by means of a microprocessor 100 which may adjust the speed of a variable speed motor 200 in accordance with a desired program. The motor 200, as seen in FIG. 2, is operable to drive the chains that move the fixed-position and drop away pusher pins. The microprocessor 100 is adapted to operate other components of the collating apparatus 20, including the two-state actuator, in accordance with the speed chosen for operating the motor 200.

One or more sensing devices 300, including conventional photocell, infrared-type or other conventional sensing devices, that are capable of detecting preset conditions including limit errors, read errors, integrity errors and handling errors can be included with the collating apparatus 20. Sensing device(s) 300 are linked through wiring to microprocessor 100.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter.

Only the preferred embodiments of the present subject matter and but a few examples of its versatility are shown and described in the present disclosure. It is to be understood that the present subject matter is capable of use in various other combinations and environments and is susceptible of changes and/or modifications within the scope of the inventive concept as expressed herein.

What is claimed is:

1. A collating apparatus comprising:

(a) a substantially elongated raceway conveyor adapted to convey a plurality of document sets consecutively along a substantially horizontal conveying pathway from an initial upstream position to a downstream position;

(b) a plurality of pivotable pusher members movably mounted to the raceway conveyor adapted to advance a first document set, said pivotable pusher members adapted to pivot from a substantially vertical first position relative to the conveyor to a substantially horizontal second position below the raceway conveyor;

(c) a plurality of fixed positioned pusher members movably mounted to the raceway conveyor adapted to advance a second document set;

(d) an actuating deck plate positioned on a upper surface of the raceway conveyor and parallel to the substantially horizontal conveying pathway;

(e) a selective actuating mechanism adapted to raise one end of the actuating deck plate from an initial position substantially flush with the upper surface of the raceway conveyor to a predetermined position above the upper surface of the raceway conveyor; and (f) a collating station comprising a first elevated platform mounted on the upper surface of the raceway conveyor downstream from the actuating deck plate.

2. The collating apparatus according to claim 1, wherein the substantially horizontal conveying pathway comprises at least one longitudinally extending slot.

3. The collating apparatus according to claim 1, wherein the plurality of pivotable pusher members and fixed positioned pusher members extend through a pair of longitudinally extending slots in the substantially horizontal conveying pathway.

4. The collating apparatus according to claim 1, wherein the plurality of pivotable pusher members and fixed positioned pusher members are movably connected to a grooved track positioned below the substantially horizontal conveying pathway.

5. The collating apparatus according to claim 1, wherein the plurality of pivotable pusher members are spaced from each other at regular intervals along a chain; and the plurality of fixed positioned pusher members are spaced from each other at regular intervals intermediate to the plurality of pivotable pusher members.

6. The collating apparatus according to claim 1, wherein the selective actuating mechanism comprises a two-state actuator.

7. The collating apparatus according to claim 6, wherein the two-state actuator is selected from a solenoid or pneumatically operated cylinder.

8. The collating apparatus according to claim 1, wherein the actuating deck plate comprises a plurality of platforms each connected by a common mechanical linkage such that each of the platforms are movably positioned by the selective actuating mechanism.

9. The collating apparatus according to claim 1, wherein the collating station comprises a second elevated platform mounted above an upper surface of the first elevated platform;

the actuating deck plate comprises a plurality of platforms each connected by a common mechanical linkage such that each of the platforms are movably positioned by the selective actuating mechanism, said selective actuating mechanism being adapted to raise one end of each of the platforms to substantially the same height as the first and second elevated platforms; and the plurality of fixed positioned pusher members are spaced from each other at regular intervals intermediate to back-to-back pivotable pusher members.

10. The collating apparatus according to claim 9, wherein the collating station comprises a third elevated platform mounted above an upper surface of the second elevated platform;

the actuating deck plate comprises a plurality of platforms each connected by a common mechanical linkage such that each of the platforms are movably positioned by the selective actuating mechanism, said selective actuating mechanism being adapted to raise one end of each of the platforms to substantially the same height as the first, second and third elevated platforms; and the plurality of fixed positioned pusher members are spaced from each other at regular intervals intermediate to three consecutive pivotable pusher members.

11. The collating apparatus according to claim 1, further comprising one or more sensing devices adapted to detect errors selected from the group consisting of limit errors, read errors, integrity errors and handling errors.

12. A method of combining a plurality of document sets into a merged packet comprising the following sequential steps:

conveying a first document set along a first conveying pathway from an initial upstream position toward a downstream collation station with at least one pivotable pusher member movably mounted to a raceway conveyor;

conveying a second document set behind the first document set with at least one fixed positioned pusher member movably mounted to the raceway conveyor;

stopping conveyance of the first document set at the collation station following a backward pivoting of the pivotable pusher member from an upright position to a downward position below the conveying pathway;

activating a selective actuating mechanism to elevate one end of an actuating deck plate to an inclined position;

conveying the second document set to a second conveying pathway above the first conveying pathway such that the second document set passes across the actuating deck plate and onto a first elevated platform mounted on the upper surface of the raceway conveyor;

simultaneously advancing both the first and second document sets at an instance when the fixed positioned pusher member arrives at the collation station and, thereby, conveying the second document set; and merging the first and second document sets on the first conveying pathway, such that the second document set overlays the first document set and forms the merged packet.

13. The method of claim 12, comprising the step of elevating the one end of the actuating deck plate to substantially the same height as the first elevated platform.

14. The method of claim 12, comprising the step of elevating the one end of the actuating deck plate with a two-state actuator.

15. The method of claim 12, comprising the step of controlling activation of the two-state actuator with a microprocessor.

16. The method of claim 12, comprising the step of controlling conveyance and stoppage of the pivotable pusher member and the fixed positioned pusher member through a microprocessor.

17. The method of claim 12, comprising the step of simultaneously advancing both the first and second document sets at an instance when the fixed positioned pusher member arrives at the collation station and, thereby, conveying the second document set down a ramp from the first elevated platform.

18. The method of claim 12, further comprising the step of processing the merged packet at a downstream inserting station.

19. The method of claim 12, comprising the step of conveying the first document set along the first conveying pathway from the initial upstream position toward the downstream collation station with a pair of pivotable pusher members movably mounted to the raceway conveyor.

20. The method of claim 19, comprising the step of conveying the second document set behind with a pair of fixed positioned pusher members movably mounted to the raceway conveyor.

21. The method of claim 12, comprising the step of stopping conveyance of the first document set at the collation station following a backward pivoting of the pivotable pusher member from an upright position to a downward position such that the pivotable pusher member is out of contact with first document set.

22. A collating apparatus comprising:

(a) a substantially elongated raceway conveyor adapted to convey a plurality of document sets consecutively along a substantially horizontal conveying pathway from an initial upstream position to a downstream position;

(b) a plurality of pivotable pusher members movably mounted to the raceway conveyor adapted to advance a plurality of document sets, said pivotable pusher members adapted to pivot from a substantially vertical first position relative to the conveyor to a substantially horizontal second position below the raceway conveyor;

(c) a plurality of fixed positioned pusher members movably mounted to the raceway conveyor adapted to advance another document set;

(d) an actuating deck plate positioned on a upper surface of the raceway conveyor and parallel to the substantially horizontal conveying pathway;

(e) a selective actuating mechanism adapted to raise one end of the actuating deck plate from an initial position substantially flush with the upper surface of the raceway conveyor to a plurality of predetermined positions above the upper surface of the raceway conveyor; and (f) a collating station comprising at least two elevated platforms mounted one on top of the other on the upper surface of the raceway conveyor downstream from the actuating deck plate, wherein the plurality of fixed positioned pusher members are spaced from each other at regular intervals intermediate to at least two consecutive pivotable pusher members.

23. The collating apparatus according to claim 22, wherein the actuating deck plate comprises a plurality of platforms each connected by a common mechanical linkage such that each of the platforms are movably positioned with a stepper motor and drive linkage.

24. The collating apparatus according to claim 22, wherein each elevated platform is adapted to accept one document set.

25. The collating apparatus according to claim 22, wherein a total number of consecutive pivotable pusher members corresponds to a total number of elevated platforms.

* * * * *